US006488512B2

(12) United States Patent
Gonzales

(10) Patent No.: US 6,488,512 B2
(45) Date of Patent: Dec. 3, 2002

(54) DEVICE FOR CONNECTING A COAXIAL CABLE TO A PRINTED CIRCUIT CARD

(75) Inventor: Olivier Gonzales, St Nicolas de Macherin (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 09/852,059

(22) Filed: May 9, 2001

(65) Prior Publication Data

US 2001/0051448 A1 Dec. 13, 2001

(30) Foreign Application Priority Data

May 10, 2000 (FR) ..... 00 05947

(51) Int. Cl.[7] ..... H01R 12/00
(52) U.S. Cl. ..... 439/63
(58) Field of Search ..... 439/63, 78, 581

(56) References Cited

U.S. PATENT DOCUMENTS 4,895,522 A 1/1990 Grabbe et al. ..... 439/63

*Primary Examiner*—Gary F. Paumen
*Assistant Examiner*—Ann McCamey
(74) *Attorney, Agent, or Firm*—Schweitzer Cornman Gross & Bondell LLP

(57) ABSTRACT

A connection device for connecting a coaxial cable to a printed circuit card, the device comprising:

a tubular socket suitable for fixing to the card; and a plug suitable for being mounted at the end of a coaxial cable, said plug comprising a tubular plug body and a central contact for connection to the central conductor of the cable, the socket and the plug being arranged so that the plug can be inserted into the socket in a direction perpendicular to the plane of the printed circuit card. The socket comprises a resilient portion suitable for urging the plug body towards the printed circuit card along said direction so as to hold the central contact of the plug pressed against a conductive track of the printed circuit card.

27 Claims, 4 Drawing Sheets

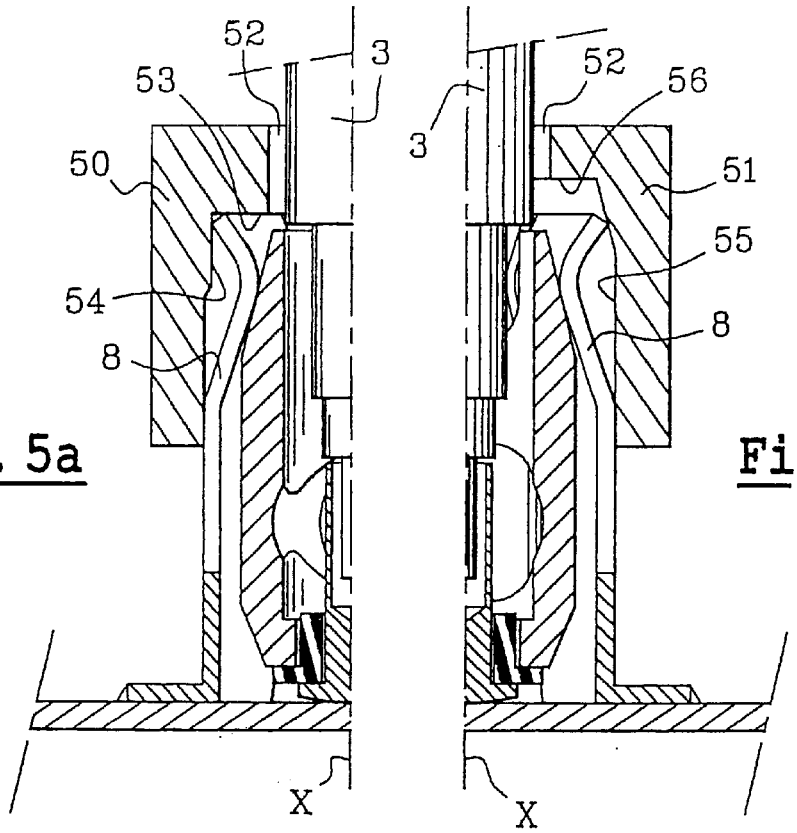
Fig. 5a
Fig. 5b
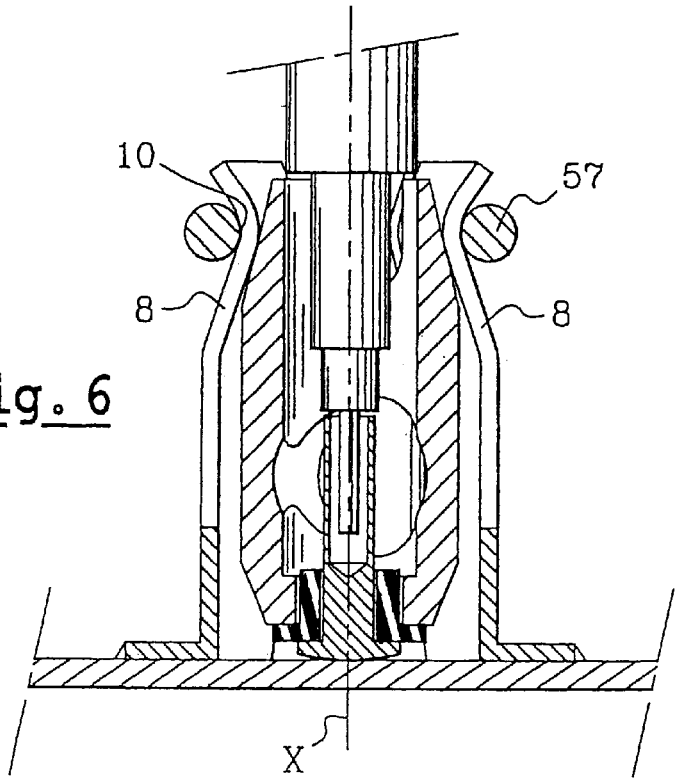
Fig. 6

DEVICE FOR CONNECTING A COAXIAL CABLE TO A PRINTED CIRCUIT CARD

The present invention relates to a device for connecting a coaxial cable to a printed circuit card.

BACKGROUND OF THE INVENTION

For connecting coaxial cables to printed circuit cards, devices are known that comprise a tubular socket suitable for being fixed to the card, and a plug suitable for mounting on the end of the coaxial cable and for inserting in the socket.

There exists a need to be able to connect a coaxial cable to a printed circuit card in a direction that is perpendicular to the card.

OBJECTS AND SUMMARY OF THE INVENTION

The invention satisfies this need by means of a connection device for connecting a coaxial cable to a printed circuit card, which device is particularly simple, low cost, and reliable, and comprises:

a tubular socket suitable for fixing to the card; and a plug suitable for being mounted at the end of a coaxial cable, said plug comprising a tubular plug body and a central contact for connection to the central conductor of the cable, the socket and the plug being arranged so that the plug can be inserted into the socket in a direction perpendicular to the plane of the printed circuit card, wherein the socket comprises a resilient portion suitable for urging the plug body towards the printed circuit card along said direction so as to hold the central contact of the plug pressed against a conductive track of the printed circuit card.

The resilient force exerted by the resilient portion of the socket serves throughout the life of the connector device to hold the coaxial cable mechanically and reliably to the printed circuit card so as to avoid any interruptions in the electrical connection between the cable and the card.

Preferably, the central contact of the plug has a projection that bears against the conductive track of the printed circuit card, enabling electrical contact to be made directly between the central contact of the plug and the conductive track of the card.

In an embodiment, the resilient portion of the socket is constituted by a plurality of elastically deformable tabs defined by slots formed over at least a fraction of the height of the socket.

Advantageously, the socket has a narrowing in its section in its elastic portion.

The plug body may have a cylindrical central portion extended at each end by a respective tapering portion comprising a top tapering portion having a bearing surface for the elastically deformable tab and a bottom tapering portion whereby the plug is engaged in the socket, the height of the top tapering portion being preferably greater than that of the bottom tapering portion.

Since said bearing surface slopes relative to the axis of the plug body, the tabs, when they press against said surface, exert a force that urges the plug body towards the printed circuit card.

The large bearing surface area provided in this way contributes to providing good mechanical retention of the plug body against the card.

In another embodiment, the resilient portion is constituted by at least one flexible tongue that is folded towards the inside of the socket.

In practice, the central conductor of the cable is mechanically and electrically connected to the central contact of the plug by solder ring or by crimping. According to the invention, the plug body has at least one opening for passing the tools that are necessary for performing the soldering or crimping operations.

Since the outer conductor of the coaxial cable is usually mechanically and electrically connected to the body of the plug by soldering or crimping, the plug body advantageously includes at least one opening for passing the tools that are necessary for performing soldering or crimping operations.

The projection of the central contact of the plug may be rigid.

In the invention, an insulating sleeve is provided that is suitable for being inserted between the projection of the central contact of the plug and the body of the plug.

The insulating sleeve can be elastically deformable, e.g. being made of elastomer, and in particular of silicone.

In a variant, the insulating sleeve is made of polymer foam.

In a particular embodiment, mechanical clearance is provided between the insulating sleeve and the projection of the central contact of the plug, allowing the central contact to move axially.

Advantageously, the device includes an outer bearing piece engaged around the resilient portion of the socket and holding said resilient portion in contact with the plug body.

This bearing piece ensures that the fixing of the plug body in the socket is reliable by preventing the resilient portion thereof from deforming in a direction that would disengage the plug body from the socket.

The bearing piece can be constituted by a cap, in particular a polymer cap.

In a variant, the bearing piece is a resilient ring engaged around the resilient portion of the socket.

The invention also provides a method of connecting a coaxial cable to a printed circuit card in a direction perpendicular to the plane of said card, the method comprising the following steps:

mounting a socket on the printed circuit card, e.g. by soldering, the socket including a resilient portion;

mounting one end of the coaxial cable on a plug comprising a plug body and a central contact, by connecting the central conductor of the cable to said central contact and by connecting the outer conductor of the cable to the plug body e.g. by soldering or by crimping; and mounting the plug body in the socket in a direction perpendicular to the plane of the printed circuit card, the resilient portion of the socket deforming during said mounting and at the end thereof exerting a force that is directed in a direction substantially perpendicular to the plane of the printed circuit card so as to hold the central contact of the plug against a conductive track of the card.

BRIEF DESCRIPTION OF THE DRAWINGS

In order to make the invention better understood, there follows a description of embodiments given as non-limiting examples and made with reference to the accompanying drawings, in which:

FIGS. 5*a*, 5*b*, and 6 are diagrammatic section views corresponding to the FIG. 1 connection device having a bearing piece mounted thereon;

MORE DETAILED DESCRIPTION

Figure 1:
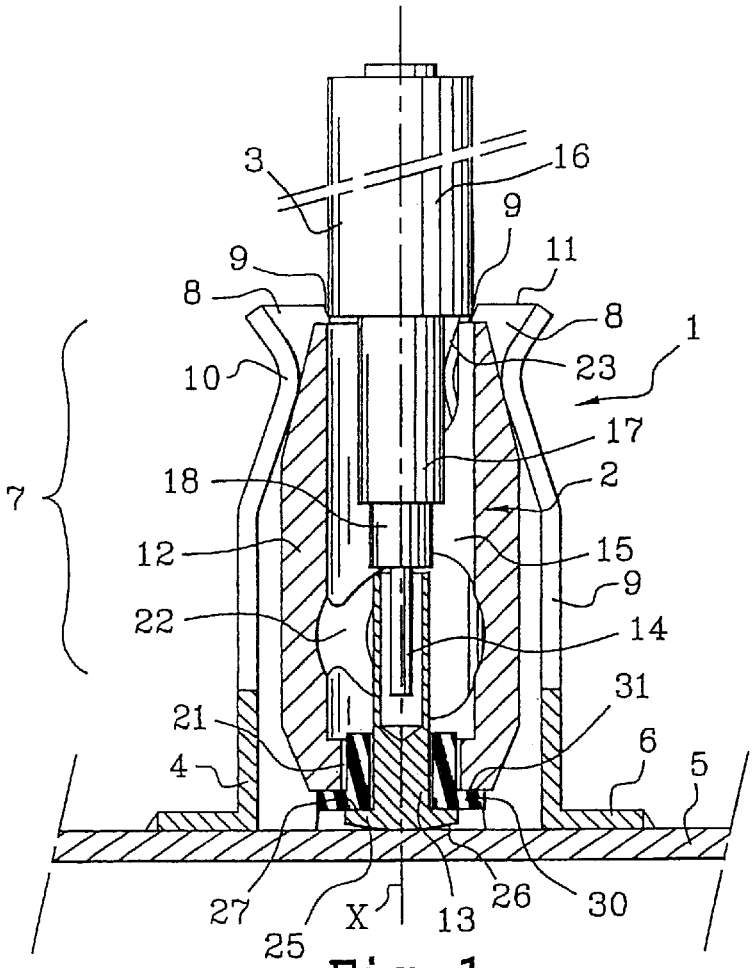
FIG. 1 is a partially cutaway diagrammatic section view of a connection device constituting a first embodiment of the invention.
Figure 2:
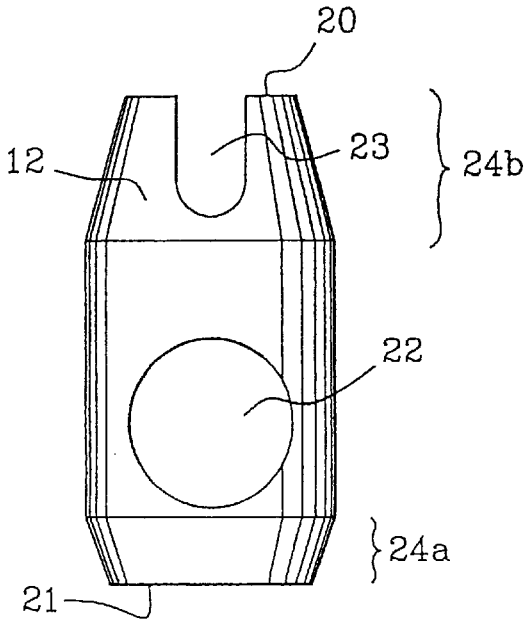
FIG. 2 is a diagrammatic elevation view of a plug body for the connection device of FIG. 1.

FIG. 1 shows a connection device 1 comprising a plug 2 mounted at the end of a coaxial cable 3, and a socket 4 fixed to a printed circuit card 5.

In the example under consideration, the socket 4 is made by cutting out and folding sheet metal, and it is fixed to the printed circuit card 5 by soldering.

The socket 4 is in the form of a tubular body of revolution about an axis X and it has a radial flange 6 at one end projecting out from the socket 4.

The flange 6 serves as a bearing surface enabling the socket 4 to be fixed on the printed circuit card 5.

Figure 3:
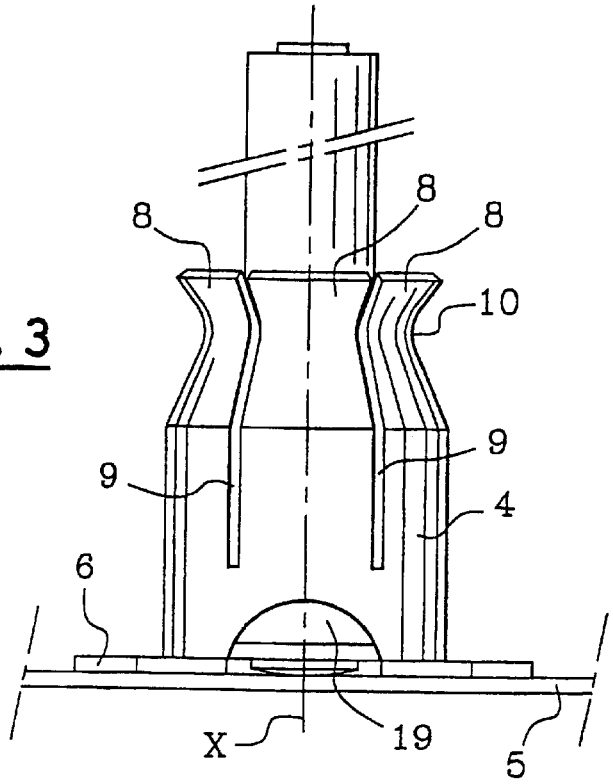
FIG. 3 is a diagrammatic elevation view of the FIG. 1 connection device.

This same end also has a semicircular side opening 19 as can be seen more clearly in FIG. 3.

The socket 4 includes a resilient portion 7 extending longitudinally from its end remote from the flange 6.

This resilient portion 7 is constituted by six elastically deformable tabs 8 defined by slots 9 occupying about two-thirds of the height of the socket 4.

The resilient tabs 8 are shaped in such a manner that the resilient portion 7 has a narrowing of its section 10.

In other words, as can be seen in particular in FIG. 1, the tabs 8 are curved in shape in longitudinal section.

The socket 4 has a circular opening 11 defined by the resilient portion 7 enabling the coaxial cable 3 to pass in such a manner as to connect it to the printed circuit card 5 in a direction that is perpendicular to the plane of said card.

The plug 2 comprises a tubular plug body 12 made in particular out of brass, and a central contact 13 in the form of a peg suitable for receiving the central conductor 14 of the cable 3 and suitable for pressing against the card 5.

The plug body 12 has a longitudinal central passage 15 passing therethrough for receiving in particular the end of a coaxial cable 3 after its outer sheath 16 has been removed therefrom.

The plug body 12 has a top circular opening 20 and a bottom circular opening 21.

The outer conductor 17 of the cable, or ground braid, passes through the opening 20 and extends into the passage 15.

A dielectric 18 between the central conductor 14 and the outer conductor 17 extends as far as the central contact 13 of the plug 2 and only the completely stripped central conductor 14 penetrates into the central contact 13.

The central conductor 14 of the cable 3 is mechanically and electrically connected to the central contact 13 of the plug 2 by welding or by crimping.

For this purpose, a side opening 22 is provided through the plug body 12 to pass the tools necessary for the soldering or crimping operation.

Similarly, the outer conductor 16 of the cable 3 is soldered in the passage 15 of the plug body 12 and is likewise provided with a side opening 23 passing through the plug body for passing the tools necessary to perform this operation. The electrical connection between the outer conductor 17 of the cable and the plug body 12 is made in this way.

The plug body 12 has a cylindrical central portion on the axis X, and at each of the ends of this portion, it has a tapering portion converging towards the outside of the plug body.

The tapering portion whereby the plug body 12 is inserted into the socket 4 is referred to as the "bottom" tapering portion 24*a*.

The tapering portion whose outside surface constitutes a bearing surface for the resilient tabs 8 is referred to as the "top" tapering portion 24*b*.

The height of the top tapering portion 24*b* is greater than that of the bottom tapering portion 24*a*, since a large bearing surface area encourages good retention of the tabs against the plug body.

Furthermore, the angle at the apex of the top tapering portion 24*b* is selected in such a manner that it causes the tabs 8 to splay apart slightly when the plug body 12 is installed in the socket 4.

Thus, the reaction force of the resilient tabs 8 on the plug body 12 push it towards the printed circuit card 5, and oppose any displacement of the plug body 12 out from the socket 4.

The central contact 13 has an axial projection 25 suitable for bearing against a conductive track (not shown) on the printed circuit card so as to provide an electrical connection between the central conductor 14 of the cable and the conductive track.

This projection 25 presents a convex face 26 for bearing against the conductive track.

The projection 25 also has a shoulder 27 at its end remote from said convex surface 26 and serving as a bearing surface for an insulating sleeve 30.

In the example described, the sleeve 30 is elastically deformable.

The insulating sleeve 30 is tubular in shape about the axis X and it has a central longitudinal passage passing therethrough enabling it to be engaged around the central contact 13 of the plug 2.

The insulating sleeve 30 also has an outwardly directed radial flange 31 at one end for bearing simultaneously against the bearing surface 27 of the projection 25 and against the outside edges of the plug body surrounding the opening 21.

The outside diameter of the sleeve 30 is smaller than that of the opening 21 of the plug body 12 in which the sleeve is partially engaged.

The inside diameter of the sleeve 30 is greater than the diameter of the central contact 13.

Thus, after the insulating sleeve 13 had been inserted between the projection 25 of the central contact 13 and the plug body 12, radial clearance exists between the plug body 12 and the insulating sleeve 30 and between the insulating sleeve 30 and the central contact 13.

Since the insulating sleeve 30 is elastically deformable, better resistance is obtained for the connection between the cable 3 and the card 5 against traction applied on the axis of the cable.

It will be observed that since the plug body 12 is made of metal, the ground braid 17 is connected to the ground tracks of the printed circuit via an electrical path that includes the plug body 12, the socket 4, and the fixing flange 6 of the socket.

The coaxial cable 3 can be disconnected from the printed circuit card 5 by exerting enough traction on the cable in a direction perpendicular to the card.

Figure 4:
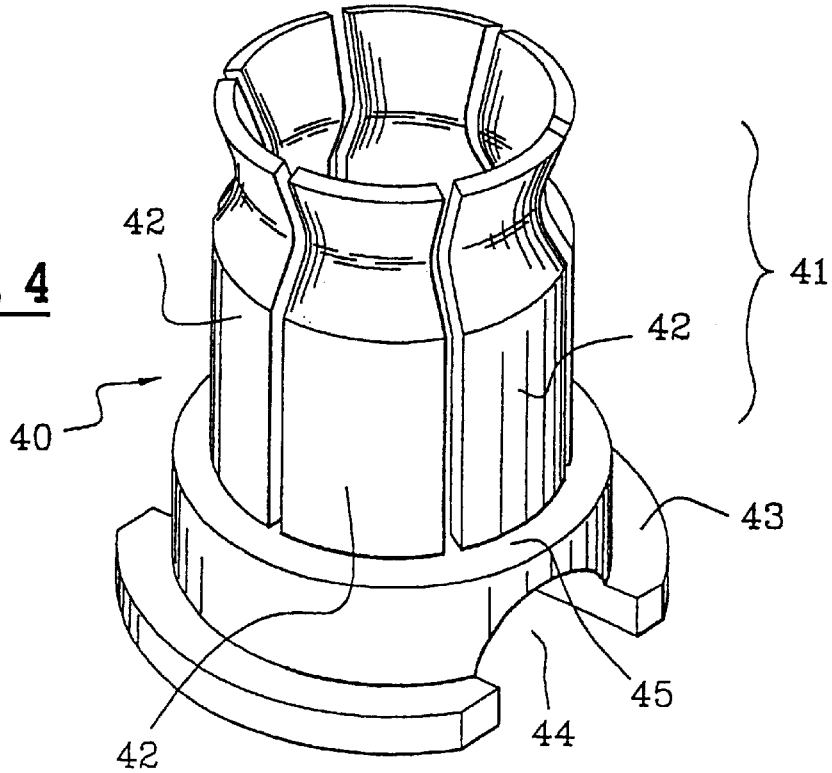
FIG. 4 is a diagrammatic perspective view of a variant socket.

FIG. 4 shows a socket 40 substantially analogous to the socket 4 which, unlike the socket 4, is made by machining a piece of metal.

Like the socket 4, the socket 40 has a resilient portion 41 constituted by elastically deformable tabs 42, a radial flange 43, and a semicircular side opening 44 situated in its bottom portion.

The socket 40 also has an outer circular shoulder 45 situated at the bottom end of the resilient portion 41.

FIGS. 5*a*, 5*b*, and 6 show the connection device of FIG. 1 having a bearing piece mounted thereon for locking the resilient portion 7 of the socket 4.

As shown in FIGS. 5*a* and 5*b*, this bearing piece is in the form of a cap 50, 51 made of a polymer, and fitted onto the resilient portion 7 of the socket in such a manner as to oppose any spreading movements of the resilient tabs 8.

In the example described, the cap has an opening 52 through which the coaxial cable 3 passes. The diameter of the opening 52 of the cap 50, 51 is greater than the diameter of the coaxial cable, so the coaxial cable can move radially in the opening 52.

The cap 50, 51 is put into place on the socket 4 by being slid from a free end of the coaxial cable 3 after the plug body 12 has been inserted in the socket 4.

Two examples of caps are shown in FIGS. 5*a* and 5*b*.

The cap 50 has an inner radial wall 53 bearing against the top edges of the tabs, and an inner side wall 54 for preventing the resilient tabs 8 from moving apart.

Another cap 51 has an inner side wall 55 bearing directly against side rims of the tabs 8 so as to oppose any movement of the tabs 8, and its inner radial wall 56 is raised relative to the tabs 8.

The caps 50, 51 present the advantage of locking the resilient portion 7 effectively, and their cost price is also small.

FIG. 6 shows a bearing piece 57 in the form of a ring that is placed around the tabs 8 in the narrower section 10 of the resilient portion 7.

This prevents the tabs 8 from moving apart.

Figure 7:
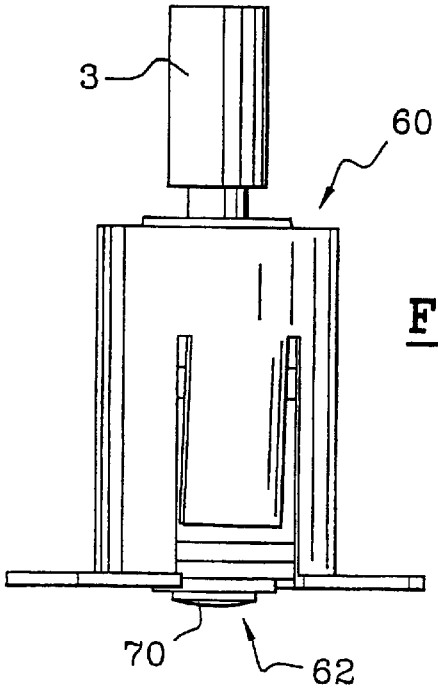
FIG. 7 is a diagrammatic elevation view of a connection device constituting a second embodiment of the invention.
Figure 8:
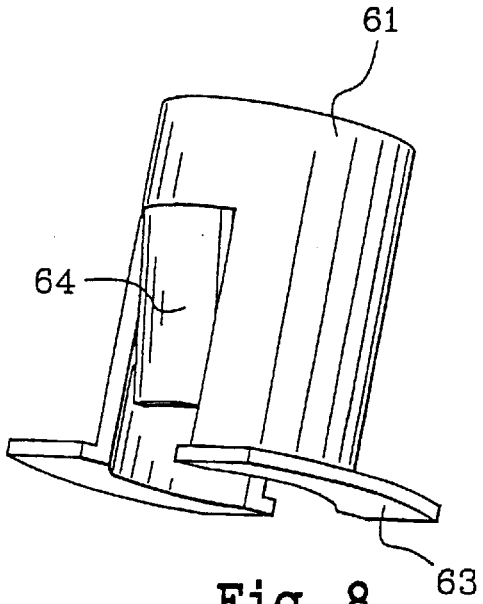
FIG. 8 is a diagrammatic perspective view of a socket for the FIG. 7 connection device.
Figure 9:
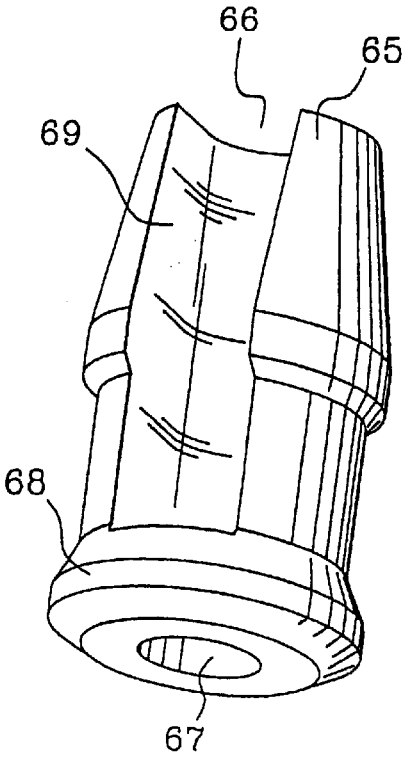
FIG. 9 is a diagrammatic perspective view of a plug body for the FIG. 7 connection device.

FIGS. 7 to 9 show a connection device constituting a second embodiment of the invention.

The connection device 60 comprises a substantially cylindrical socket 61 for fixing on a printed circuit card (not shown) and a plug 62 for connection to the end of a coaxial cable 3.

The socket 61 has an outwardly directed radial flange 63 enabling the socket to be fixed to a printed circuit card.

The socket also has at least one rectangular flexible tongue 64 that is folded towards its inside and that is capable of deforming elastically outwards.

The plug 62 comprises a cylindrical tubular plug body 65 presenting top and bottom circular openings 66 and 67 at opposite ends.

The plug body 65 has an enlargement 68 of cylindrical and conical section in its portion that is inserted into the socket 61, the tapering portion of the enlargement serving as a bearing surface for the tongue(s) 64.

The plug body 65 also has a longitudinal slot 69 extending from the top opening 66 to the vicinity of the enlarged section 68.

Like the preceding embodiment, the circular opening 67 serves to pass a projection 70 on a central contact of the plug 62.

To connect the cable 3 to the printed circuit card, the socket 61 is fixed initially onto the card and then the plug 62 is mounted separately to the end of the coaxial cable 3.

Thereafter, the plug body 65 is inserted into the socket 61, moving the flexible tongue 64 outwards so as to allow the enlarged portion 68 of the plug body 65 to move past it.

Naturally, the embodiments described above are not limiting in any way and could receive any desirable modification without thereby going beyond the ambit of the invention.

What is claimed is:

1. A connection device for connecting a coaxial cable to a printed circuit card, the device comprising:

an electrically conductive tubular socket suitable for fixing to the card; and a plug suitable for being mounted at the end of a coaxial cable, said plug comprising a tubular plug body and a central contact for connection to the central conductor of the cable, the socket and the plug being arranged so that the plug can be inserted into the socket in a direction perpendicular to the plane of the printed circuit card, wherein the socket comprises a resilient portion suitable for urging the plug body towards the printed circuit card along said direction so as to hold the central contact of the plug pressed against a conductive track of the printed circuit card.

2. A device according to claim 1, wherein the socket has a narrowing in its section in its elastic portion.

3. A device according to claim 1, wherein the resilient portion is constituted by at least one flexible tongue that is folded towards the inside of the socket.

4. A device according to claim 1, the central conductor of the cable being mechanically and electrically connected to the central contact of the plug by solder ring or by crimping, wherein the plug body has at least one opening for passing the tools that are necessary for performing the soldering or crimping operations.

5. A device according to claim 1, the outer conductor of the coaxial cable being mechanically and electrically connected to the plug body by soldering or crimping, wherein the plug body includes at least one opening for passing the tools that are necessary for performing the soldering or crimping operations.

6. A device according to claim 1, wherein said resilient portion is integrally made with said socket.

7. A device according to claim 1, wherein said resilient portion bears against said plug body.

8. A device according to claim 1, wherein said resilient portion is situated at a top portion of said socket.

9. A device according to claim 1, wherein said central contact bears against the printed circuit card without being attached thereto.

10. A device according to claim 1, wherein said plug body comprises an enlarged portion situated in the vicinity of the bottom end of said plug body and serving as a bearing surface for said resilient portion.

11. A device according to claim 1, wherein the central contact of the plug has a projection that bears against the conductive track of the printed circuit card.

12. A device according to claim 11, wherein the projection of the central contact of the plug is rigid.

13. A device according to claim 11, wherein an insulating sleeve is inserted bet ween the plug body and the projection of the central contact of the plug.

14. A device according to claim 13, wherein mechanical clearance is provided between the insulating sleeve and the projection of the central contact of the plug.

15. A device according to claim 13, wherein the insulating sleeve is elastically deformable.

16. A device according to claim 15, wherein the insulating sleeve is made of elastomer, in particular of silicone.

17. A device according to claim 15, wherein the insulating sleeve is made of polymer foam.

18. A device according to claim 1, including an outer bearing piece engaged around the resilient portion of the socket and holding said resilient portion in contact with the plug body.

19. A device according to claim 18, wherein said bearing piece is constituted by a cap, in particular a polymer cap.

20. A device according to claim 18, wherein said bearing piece is a resilient ring engaged around the resilient portion of the socket.

21. A device according to claim 1, wherein the resilient portion of the socket comprises a plurality of elastically deformable tabs defined by slots formed over at least a fraction of the height of the socket.

22. A device according to claim 21, wherein said resilient portion has a top edge and wherein said slots extend to said top edge.

23. A method of connecting a coaxial cable to a printed circuit card in a direction perpendicular to the plane of said card, the method comprising the following steps:

mounting a socket on the printed circuit card, e.g. by soldering, the socket including a resilient portion;

mounting one end of the coaxial cable on a plug comprising a plug body and a central contact, by connecting the central conductor of the cable to said central contact and by connecting the outer conductor of the cable to the plug body, e.g. by soldering or by crimping; and mounting the plug body in the socket in a direction perpendicular to the plane of the printed circuit card, the resilient portion of the socket deforming during said mounting and at the end thereof exerting a force that is directed in a direction substantially perpendicular to the plane of the printed circuit card so as to hold the central contact of the plug against a conductive track of the card.

24. A connection device for connecting a coaxial cable to a printed circuit card, the device comprising:

(a) an electrically conductive tubular socket suitable for fixing to the card; and (b) a plug suitable for being mounted at the end of a coaxial cable, said plug comprising a tubular plug body and a central contact for connection to the central conductor of the cable, the socket and the plug being arranged so that the plug can be inserted into the socket in a direction perpendicular to the plane of the printed circuit card, wherein the socket comprises a resilient portion suitable for urging the plug body towards the printed circuit card along said direction so as to hold the central contact of the plug pressed against a conductive track of the printed circuit card, wherein the resilient portion of the socket comprises a plurality of elastically deformable tabs, wherein the socket has a narrowing in its section in its elastic portion, and wherein the plug body has a cylindrical central portion extended at each end by a respective tapering portion comprising a top tapering portion having a bearing surface for the elastically deformable tabs and a bottom tapering portion whereby the plug is engaged in the socket.

25. A device according to claim 24, wherein the height of the top tapering portion is greater than that of the bottom tapering portion.

26. A connection device for connecting a coaxial cable to a printed circuit card, the device comprising:

(a) an electrically conductive tubular socket suitable for fixing to the card; and (b) a plug suitable for being mounted at the end of a coaxial cable, said plug comprising a tubular plug body and a central contact for connection to the central conductor of the cable, the socket and the plug being arranged so that the plug can be inserted into the socket in a direction perpendicular to the plane of the printed circuit card, wherein the socket comprises a resilient portion suitable for urging the plug body towards the printed circuit card along said direction so as to hold the central contact of the plug pressed against a conductive track of a printed circuit card, wherein the resilient portion of the socket comprises a plurality of elastically deformable tabs, and wherein the plug body has a cylindrical central portion extended at each end by a respective tapering portion comprising a top tapering portion having a bearing surface for the elastically deformable tabs and a bottom tapering portion whereby the plug is engaged in the socket.

27. A connection device for connecting a coaxial cable to a printed circuit card, the device comprising:

(a) an electrically conductive tubular socket suitable for fixing to the card; and (b) a plug suitable for being mounted at the end of a coaxial cable, said plug comprising a tubular plug body and a central contact for connection to the central connector of the cable, the socket and the plug being arranged so that the plug can be inserted into the socket in a direction perpendicular to the plane of the printed circuit card, wherein the socket comprises a resilient portion suitable for urging the plug body towards the printed circuit card along said direction so as to hold the central contact of the plug pressed against a conductive track of the printed circuit card, and wherein the plug body has a cylindrical central portion extended at each end by a respective tapering portion comprising a top tapering portion having a bearing surface for the resilient portion and a bottom tapering portion whereby the plug is engaged in the socket.

* * * * *